United States Patent [19]

Batty

[11] Patent Number: 4,984,438

[45] Date of Patent: Jan. 15, 1991

[54] PROCESSING OF DENIM GARMENTS

[75] Inventor: Denis Batty, Huddersfield

[73] Assignee: Kedgwick Limited, Ossett, England

[21] Appl. No.: 298,102

[22] Filed: Jan. 17, 1989

[30] Foreign Application Priority Data

Jan. 15, 1988 [GB] United Kingdom ..... 8800937

[51] Int. Cl.[5] ..... D06F 21/02; D06F 37/08

[52] U.S. Cl. ..... 68/27; 68/143

[58] Field of Search ..... 68/27, 58, 143, 145; 134/65, 132

[56] References Cited

U.S. PATENT DOCUMENTS 2,056,803 10/1936 Failing ..... 68/58 X
2,062,030 11/1936 Johnson ..... 68/143
3,103,802 9/1963 Streich ..... 68/58 X
3,760,613 9/1973 Henderson ..... 68/143
3,969,913 7/1976 Schaper ..... 134/65 X
4,236,393 12/1980 Katzfey ..... 68/27
4,519,224 5/1985 Seifert et al. ..... 68/58 X

*Primary Examiner*—Philip R. Coe
*Attorney, Agent, or Firm*—Klauber & Jackson

[57] ABSTRACT

An archimedian screw washing machine is adapted for washing denim garments which have to be stone washed. The screw is adapted in that it is provided with lifter panels which cause the denim garments, and wash liquor supplied with the garments, to tumble and cascade as the screw is rocked back and forth. The invention also is a method of washing garments using the screw and supplying various washing compositions.

2 Claims, 9 Drawing Sheets

PROCESSING OF DENIM GARMENTS

This invention relates to the processing of denim garments, and in particular concerns the washing of denim garments such as jackets and trousers having sleeves and legs. The invention provides a machine for the washing of denim garments, and also provides a method of washing denim garments utilising the machine.

Denim garments are manufactured from denim cloth, and the yarns which are used to produce the denim cloth are treated with size in order to enhance the weaving process. One side of the denim cloth, the face side, is treated with a dye, most commonly a blue dye but to a lesser extent a black dye for the colouration of the cloth and when the garments are first produced from the cloth, they are quite stiff in texture. In the past, garments in this condition have been sold direct to the public, but more recently the high public demand is for the garments to be washed, and in particular stone washed, to improve the softness, flexibility and drapability of the garments. Stone washing as will be explained hereinafter is a process of washing denim garments with stones and washing liquid, the stones exercising an abrading effect on the cloth during the washing process.

Denim garments, in particular trousers called "blue jeans" are sold in vast numbers throughout the world so much so that there is a whole industry devoted to the washing of denim garments. The larger denim garment manufacturers often have their own stone washing companies.

Conventionally, for the stone washing of jeans, and reference will be made hereinafter only to jeans in the interests of simplicity, but it is to be mentioned that the invention is not in any way to be limited thereto, a batch of pairs of jeans, say thirty, is initially placed in a washing machine in the form of a washing drum arranged with its axis horizontal, and for rotation about its axis. The drum has a loading and unloading aperture at one end which can be sealed closed by means of a door. The jeans are simply loaded into the washing machine after being turned inside out, with an appropriate quantity of a washing liquor comprising water and a desizing enzyme. The water is either hot when inserted into the washing machine, or is heated when in the washing machine. During the washing process, the drum of the washing machine rocks back and forth about its axis so that the jeans are tumbled with the washing liquor. No stones are included in the washing machine at this time, and the purpose of this washing step is to remove the size from the jeans. This washing process also removes some of the dye from the jeans. After a predetermined time, the drum is rotated at high speed in order to centrifuge the liquor from the jeans so that the jeans are spun dry, and after the spin drying, the machine is stopped and the jeans are removed and are usually heated so as to remove any residual moisture in the jeans. Following the heating to dryness step, the jeans are then turned the correct way out and are recharged into the washing machine with a quantity of stones, and washing water which again may be heated if desired. A stone washing process now takes place for a predetermined length of time, and in this process the drum is again rotated back and forth so that the stones and jeans tumble with the washing liquid. The purpose of this step is to abrade the fabric of the jeans to give them a worn appearance. The stones particularly abrade the hems, seams and the fabric panels of the jeans. At the end of this step, the liquid is again drained off by centrifugal action and the jeans and stones are removed, the garments again being finally dried by heat treatment, when they are ready for final pressing and despatch. This method of washing is referred to hereinafter for convenience as a "batch" washing process.

The washing machines described above are known as washing/extracting machines being of a nature in which the jeans can be washed, and also in which the jeans can be partially dried by extraction of the water, in other cases the machines are capable only of washing in which case the jeans must be removed after each washing step and placed in a spin drying machine and/or heating apparatus for removal of the residual moisture.

The effect of stone washing is to abrade the fabric to give the jeans the appearance of having been worn without being worn out as this appearance in jeans is highly fashionable.

A disadvantage of washing denim jeans in the manner described above is that the process is relatively slow in requiring insertion and removal of batches of jeans; it is also untidy in that the insertion and removal of jeans invariably there are spillages of washing liquid and stones, but a principle disadvantage is that the process is labour intensive and therefore it is expensive.

In an effort to accelerate the process, and to remove some of the need for labour, a known continuous operation washing machine (not normally used for jeans or any denim garments) was used for carrying out the first stage of the washing operation described above. Such laundry machine comprises essentially an elongated cylindrical washing drum which is arranged with its axis horizontal, and contained in the drum is a screw conveyor forming an archimedean screw. The spaces between adjacent flights of the screw comprise treatment compartments. Such laundry machines are used for example for washing batches of sheets and pillow cases and heretofore have been deployed for example in hospital laundries and large laundry contracting companies. These machines operate in that a batch of products to be washed, for example sheets and pillow cases is charged into the first compartment of the screw at one end of the machine along with a quantity of washing water. The screw is rocked back and forth for a predetermined number of cycles thereby effecting a washing and tumbling action on the batch of products and at the end of the predetermined number of cycles, the screw turns by one revolution which has the effect of advancing the batch of products into the next compartment, and at the same time a fresh batch of products to be washed is charged into the first compartment. The second compartment also contains washing liquid and/or rinsing liquid, as do all of the compartments of the machine and therefore the batches of products advance through the machine on a stepwise basis after the predetermined plurality of cycles between each step, until the batches are discharged one at each full revolution of the screw, at the other end of the machine. Typically, the known machine comprises in the first several compartments a pre-wash section, in the middle group of compartments a main wash section, and in the remaining compartments a rinsing section. A process of washing on such a machine will be referred to hereinafter as a "continuous" process although the jeans move through the machine in batches.

Upon utilisation of such a laundry machine for the washing of jeans to remove the size therefrom, considerable difficulty was experienced. The jeans are turned inside out and passed through the machine in batches, desizing enzymes being added in the main wash section, but the results obtained were totally unsatisfactory insofar as the bunches of jeans tended to twist in the legs and to knot or fold up together with the result that the garments had to be disentangled, and when they were disentangled it became clear that they had been subjected to unacceptable creasing which resulted, in the final stone washing stage, in the appearance of either dark coloured dye streaks or light streaks where insufficient or excess dye had been removed. From a quality standard point of view, the garments were unacceptable.

The present invention in a first aspect arose out of an urgent and critical need to improve the machine to enable it to satisfactorily process jeans.

According to a first aspect of the invention therefore there is provided a washing machine of the archimedes scroll type as described herein, wherein at least some and preferably each of the chambers is provided with lifter means located at or towards the inner surface of the drum, said lifter means being adapted to raise the batch of garments or some of them as the drum rocks back and forth to a predetermined height but which also cause the garments to cascade from the lifting means and fall to the bottom of the drum between the lifter means and the drum axis.

Preferably there are at least two of said lifter means in each compartment except the last compartment which has only a single lifter means.

Each lifter means may comprise a V-sectioned panel which extends between the flights of each chamber, the ends of the panel being secured such as by welding to said flights, and the broad base of the panel being secured to the drum inner surface so that the apex of the V-section points towards the axis of the drum. The panels are preferably of a predetermined length in relation to the diameter of the drum, the sides of the panel defining predetermined angles and the positions of the panels are of significance, and are as recited hereinafter when a specific embodiment of the invention is described.

The method of the invention comprises the utilisation of the above machine in conjunction with the injection into the chambers during the running of the machine, of certain chemical preparations, and in accordance with one aspect of the method of the invention, into the first compartment of the machine is injected hot water and a desizing enzyme preparation.

The enzyme preferably is an enzyme concentrate plus water and a stabilizer, typically common salt. The purpose of the enzyme preparation is to remove the size on the jeans and some of the colour without creating streaks in the finished garments. The enzyme concentrate may be a bacterial analase which splits or breaks the long chains in the starch composition used in the size. The effect of breaking the chains is to liquify the starch so that it becomes wet and the jean fabric softens.

Preferably, a controlled amount of clean water at a temperature of 50° to 70°C., depending upon the type of fabric, is introduced into the first compartment along with the enzyme preparation and a batch of jeans.

Preferably, the batch of jeans when in the first compartment are subjected to desizing by the rocking back and forth of the archimedean screw, following which the batch of jeans and the wash liquor are advanced by turning the screw by one revolution, into the second compartment which has drain means and some of the wash liquor is drained leaving a fixed amount of liquor with the jeans to progress to the next compartment when the screw once more turns through a full revolution.

Depending upon the colour of the jeans required after stone washing, so the jeans are subjected to the actions of further chemicals as they pass through the subsequent washing compartments of the machine. Thus, when the finished jeans are to be light blue, into one of the wash compartments, e.g. compartment 3, 4 or 5 may be introduced a quantity of a blend of alkali detergent (e.g. aniance detergent LANCROPOL OPA) and sequestrant for scouring and removing size from the fabric of the jeans, and if required a second chemical in the form of a blend of colloidal silica and detergent in order to improve the abrasion (stone washed) effect of the finished jeans. Hydrogen peroxide may also be added at this compartment.

The process may comprise seven washing compartments, and the compartments 2 to 7 are hydraulically coupled by means of apertures in the flight of the screw so that the wash liquor level in the said compartments 2 to 7 is substantially constant.

There may be three compartments 8 to 10 for rinsing, and when jeans which are to be light blue in colour are being washed, clean rinsing cold water is supplied to compartment 8, which is also connected to drain so that all of the washing liquor runs directly to drain whilst the cold water gives a flushing action which removes most of the loose dye created in the previous wash compartments, and flushing water at 50°C. and bleach (sodium bypochlorite) are added at compartment 9 for bleaching of the jeans and removing loose dye, whilst at compartment 10 water at 50°C. and a chemical conditioner for preventing press marks when the jeans are pressed in a membrane press to remove water immediately they are discharged from the last compartment of the machine, but the chemical conditioner is not required if the jeans are dried in a spin drying machine so they are not subjected to as high a pressure in such process as they are when they are pressed by a membrane press.

When relatively dark blue jeans are required, the jeans are subjected to the desizing enzyme and hot water treatment in compartment 1 as described above, but instead of the bleach of alkali detergent and sequestrant for scouring and removing size, a cationic softening agent for producing special effects on the jeans is added, preferably in compartment 4, and again in compartment 9 in place of the bleach. The softening agent acts as a fibre lubricant which minimises friction, but jeans treated in this way are not good for stone washing.

It has been found that by using the machine and methods as described above, jeans may be satisfactorily stone washed after being removed from the machine, and that it is not necessary to turn the jeans face in before commencing the washing process. There are less creases and dye (or absence of dye) streaks on the finished jeans, producing garments of a higher quality. The jeans are more readily abraded to give the stone washed effect. There is less unevenness in the finished jeans because of improved preparation.

The invention in its preferred embodiment furthermore provides for reduced operating costs, increased output and reduced wash faults. The invention provides a method and machine for the stone washing of jeans whereby the washed jeans have a streak free uniform finish and the jeans are superbly prepared for separate stone washing in batch machines. By so preparing the jeans, the number of stone washing cycles required is reduced leading to increased stone washing capacity and reduced costs. The use of a continuous, modified machine furthermore leads to reduced labour costs, reduced energy costs and uniformity of finish, and identification of work is easy to control.

The machine may be provided with appropriate electrical controls for controlling the sequencing and operation of the machine to ensure that there is complete transfer of each batch of garments from one compartment to another.

The supply of water and enzyme to compartment 1 is particularly controlled in that there is a water supply tank which is fitted with water level control equipment for controlling the amount of water entering compartment 1 at each charge of a batch of jeans thereinto, and a heating control means also serves to control the temperature of the water to an accurate degree. Also, control is provided to ensure that the enzyme enters compartment 1 mixed with the clean wash water. The enzyme gives the desired effect of an immediate reaction in the dry unprocessed jeans as they enter compartment 1.

In a modified form of the invention as applied to a batch process, a batch of jeans to be washed is loaded face outwards into a batch washing machine, with hot water and the machine is operated for a first pre-set period, the machine drum being rocked and/or rotated during this period. After this period, a quantity of said enzyme being an enzyme concentrate, water and a stabilizer is added, and the machine operated for a second pre-set period, following which a quantity of said alkali detergent and sequestrant blend is added and the machine is operated for a third pre-set period. After draining of the wash liquor either by spin drying the jeans in the same machine or by removing same and placing same in another machine, water, stones (pumice stones) and a quantity of said blend of colloidal silica and detergent for improving abrasion of the jeans is added and the machine is operated for a fourth pre-set period, following which the jeans are finally rinsed, the stones removed and the jeans are dried.

The said first pre-set period may be one minute, the second pre-set period may be 10–15 minutes, the third period may be 30 minutes. The hot water supplied with the jeans may be at 50°C.

Preferably, two liters of the enzyme preparation are added to the washing machine; two liters of said alkali detergent and sequestrant are added; and one liter of said colloidal silica and detergent are used.

An embodiment of the invention will now be described, by way of example, with reference to the accompanying drawings, wherein.

Figure 1:
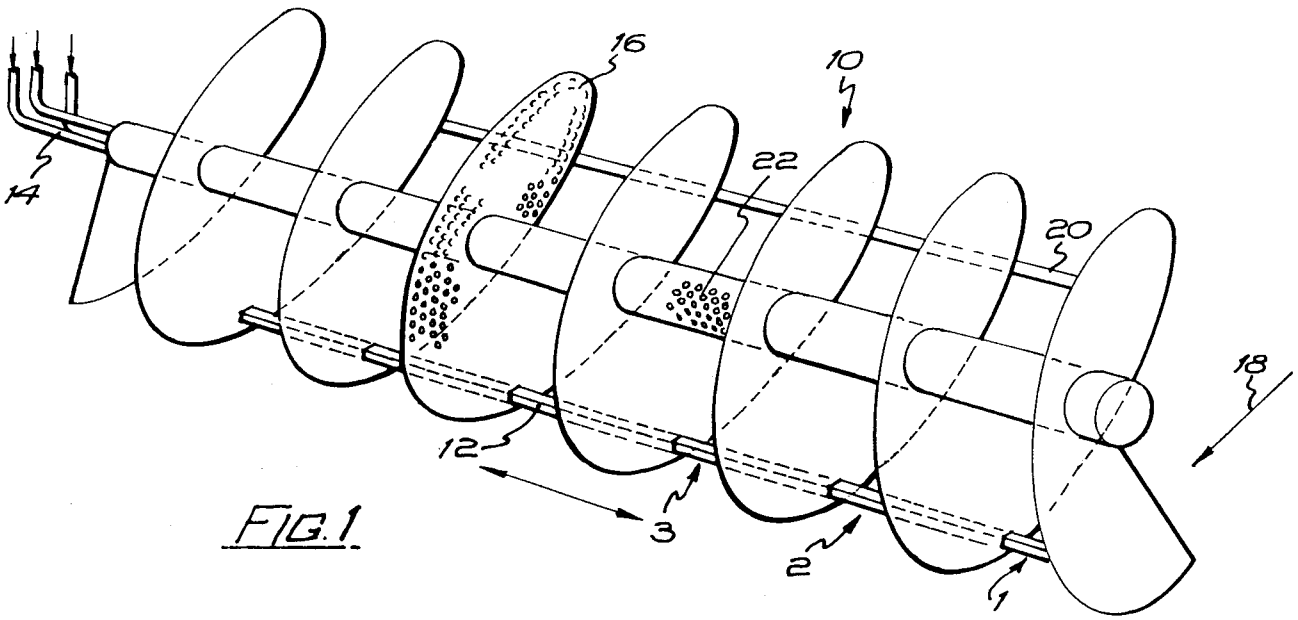
FIG. 1 is a diagrammatic perspective elevation illustrating the archimedean screw of the machine according to the embodiment of the invention.
Figure 5:
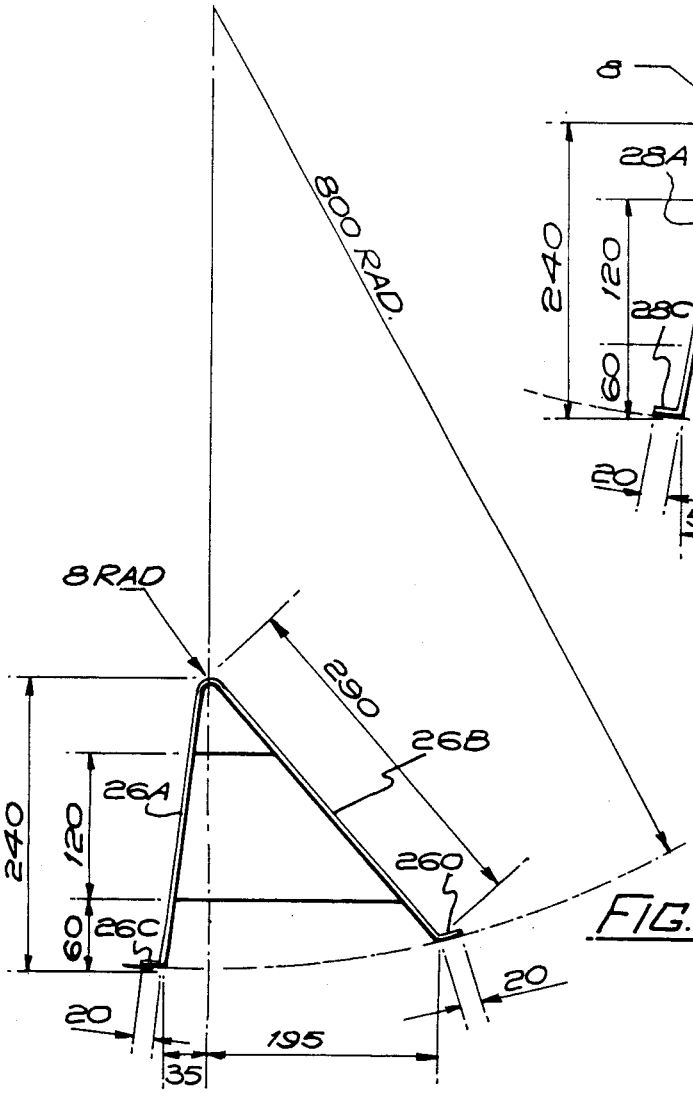
Figure 7:
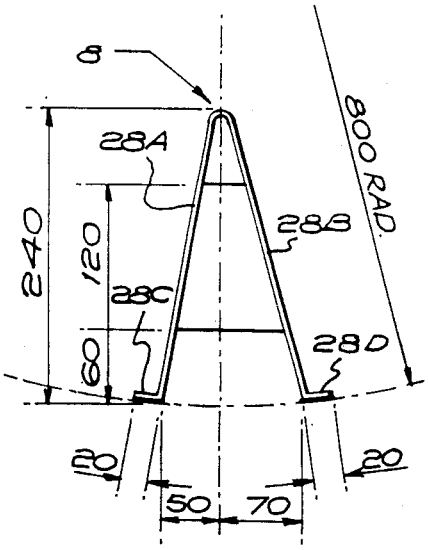
Figure 9:
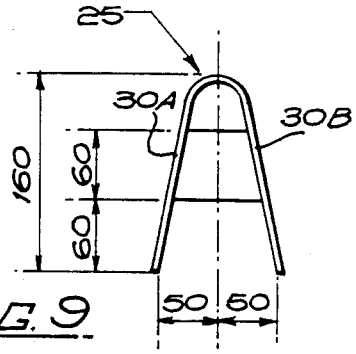
Figure 6:
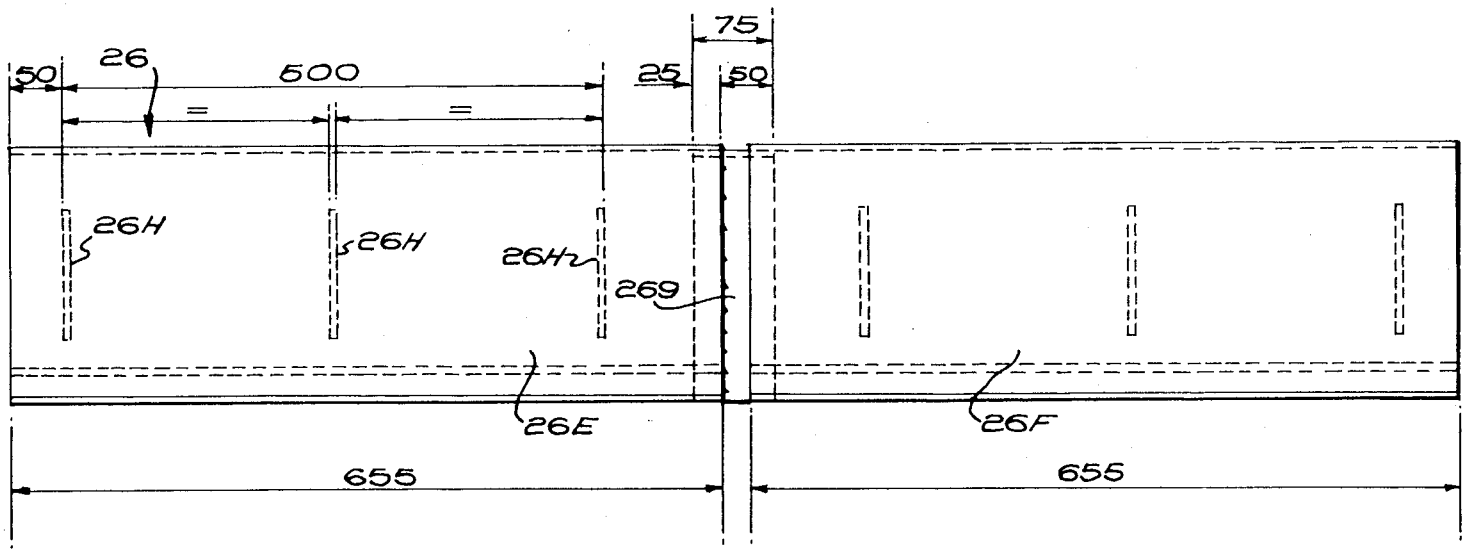
Figure 8:
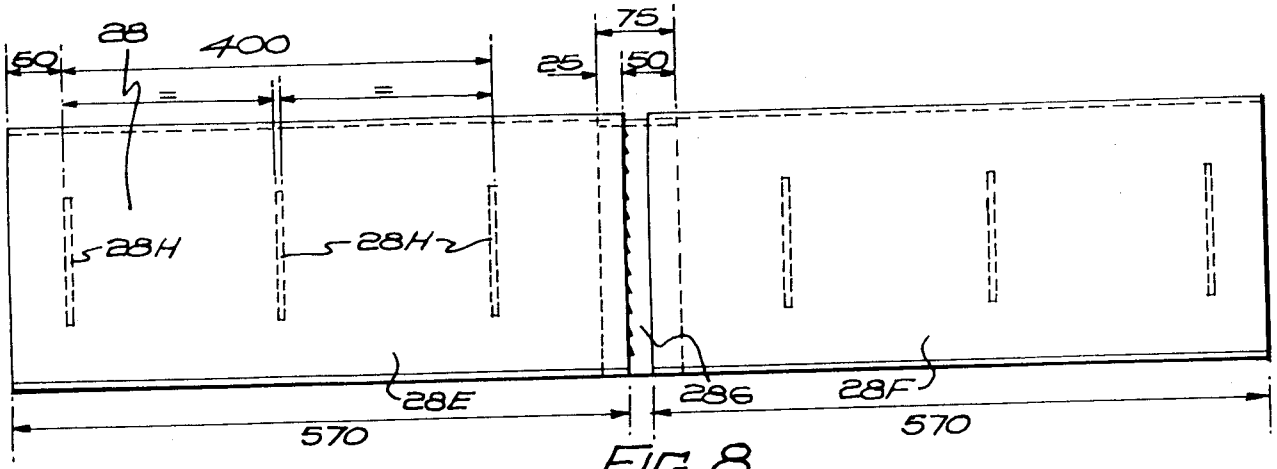
Figure 10:
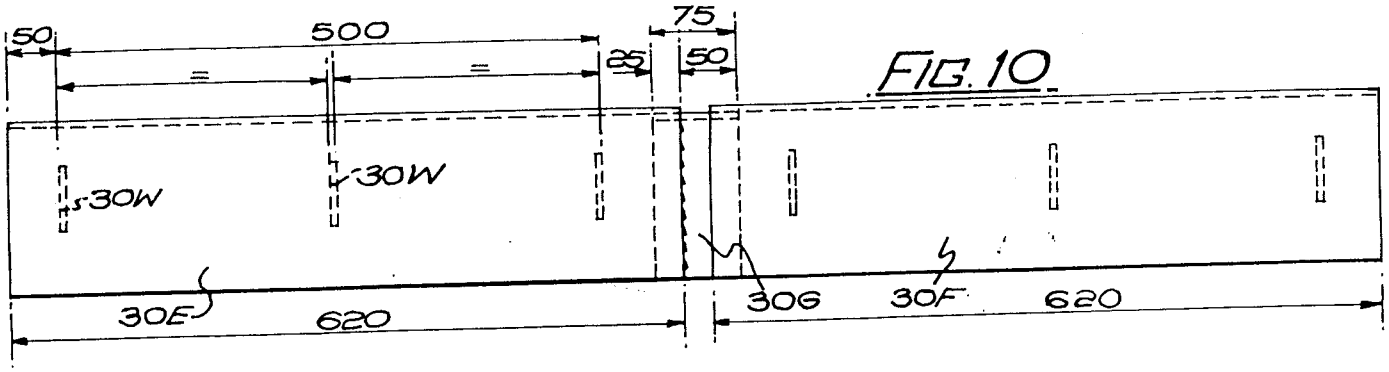
Figure 12:
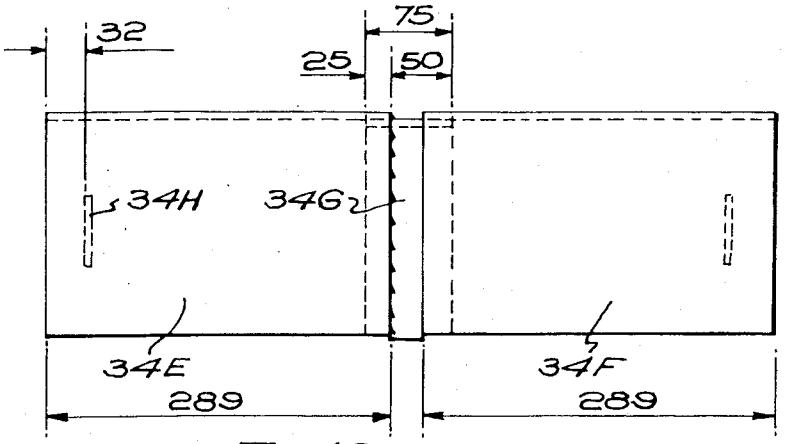
Figure 11:
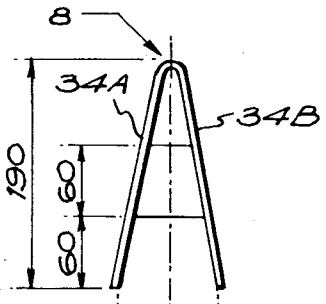
Figure 13:
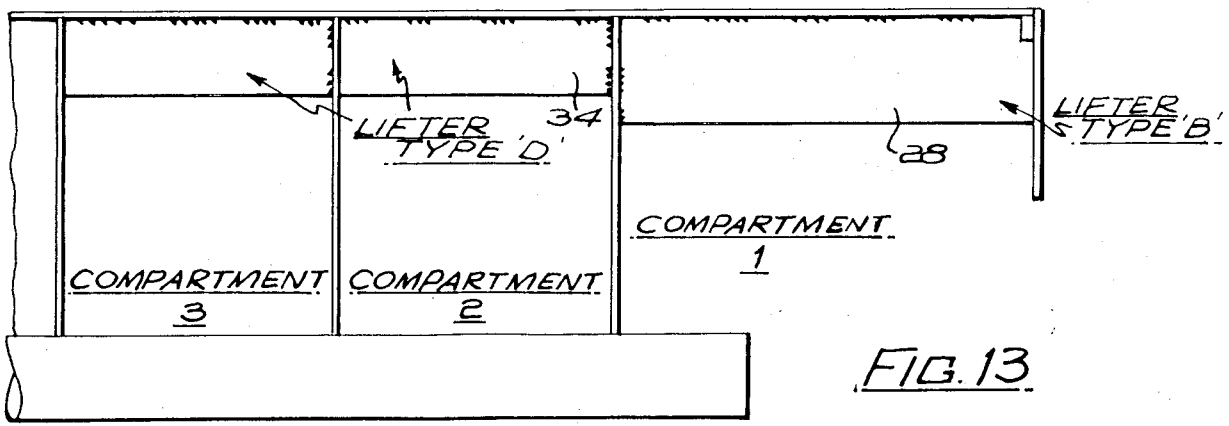
Figure 14:
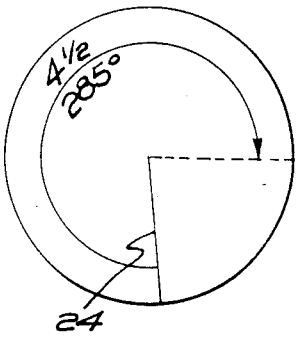

FIGS. 5 and 6 respectively are an end view and side view of a lifter panel which is provided in compartment 1 of the machine;

FIGS. 7 and 8 are respectively an end view and a side view of a lifter panel which is provided in compartment 1 of the machine;

FIGS. 9 and 10 are an end view and side view of a lifter panel which is provided in compartment 1 of the machine;

FIGS. 11 and 12 are an end view and a side view of a lifter panel which is provided in each of the remaining compartments of the machine except compartment 1; and FIG. 13 is a side view of part of the machine showing compartments 1, 2 and 3 and the lifter panels therein;

FIGS. 14 to 22 are end views of the screw shown in FIG. 1 but in different positions in order to explain the cycle of operations of the screw.

Referring to the drawings, and firstly to FIG. 1, in this figure is shown an archimedean screw 10 arranged with its axis horizontal. The axis is defined by a tube 12 passing through the screw flights as shown, the tube is hollow and at the left hand end in FIG. 1, which is the discharge end of the machine, the tube receives inlet pipes 14 for the supply of detergent and other chemicals, as well as rinsing water. The screw 10 although not shown in FIG. 1 is contained in a drum which is secured to the outer rims of the flights, so that between flights there are defined machine compartments 1, 2, 3 and so on from the input or right hand end of the machine to the discharge end of the machine. In the specific machine which has been used, there are ten of the said compartments. Certain of the flights are provided with apertures 16 whereby liquid can flow between adjacent compartments. The drum in which the screw is contained, is adapted to be driven by appropriate drive machinery not shown, and the screw arrangement shown in FIG. 1 operates basically as follows. Products to be washed are inserted in compartment 1 as indicated by arrow 18. The chamber 1 is adapted to contain sufficient amount of water for the products being inserted, but it is to be noted that the products and the water will form a charge which generally speaking lies in the lower half of the drum i.e. under the tube 12. To effect washing of the products, the screw 10 is rocked backwards and forwards and bars 20 extending between the flights as shown tend to cause the products and liquor to roll, tumble and cascade as the screw is rocked back and forth. After a predetermined number of rockings, the screw 10 is then turned basically by one revolution, which causes the products and the liquor in which they are contained, to advance into compartment 2, and the rocking process is repeated. As the cycles repeat, the charges of products and liquor progress through the compartments of the machine until eventually the batches are discharged one by one from the discharge end. Chemicals for washing and the like are injected at various positions along the tube 12, and the tube is provided with apertures at appropriate positions for this purpose. The drum casing may also be provided with drain pipes through which the liquor can drain, in order to keep the liquor in any one or more compartments at a predetermined level.

The machine thus far described is of conventional construction and operation, and is utilised typically for cleaning sheets for example in hospitals or large scale laundry operations, but the machine is modified as described herein in order to render same suitable for the washing of jeans. It was found in washing jeans in the machine basically as shown in FIG. 1, that the jeans of which a batch may comprise thirty pairs of jeans, the legs twisted and knotted and balled with the legs of other pairs of jeans with the result that when the jeans were discharged from the discharge end of the machine they were unsatisfactorily balled and knotted.

Figure 2:
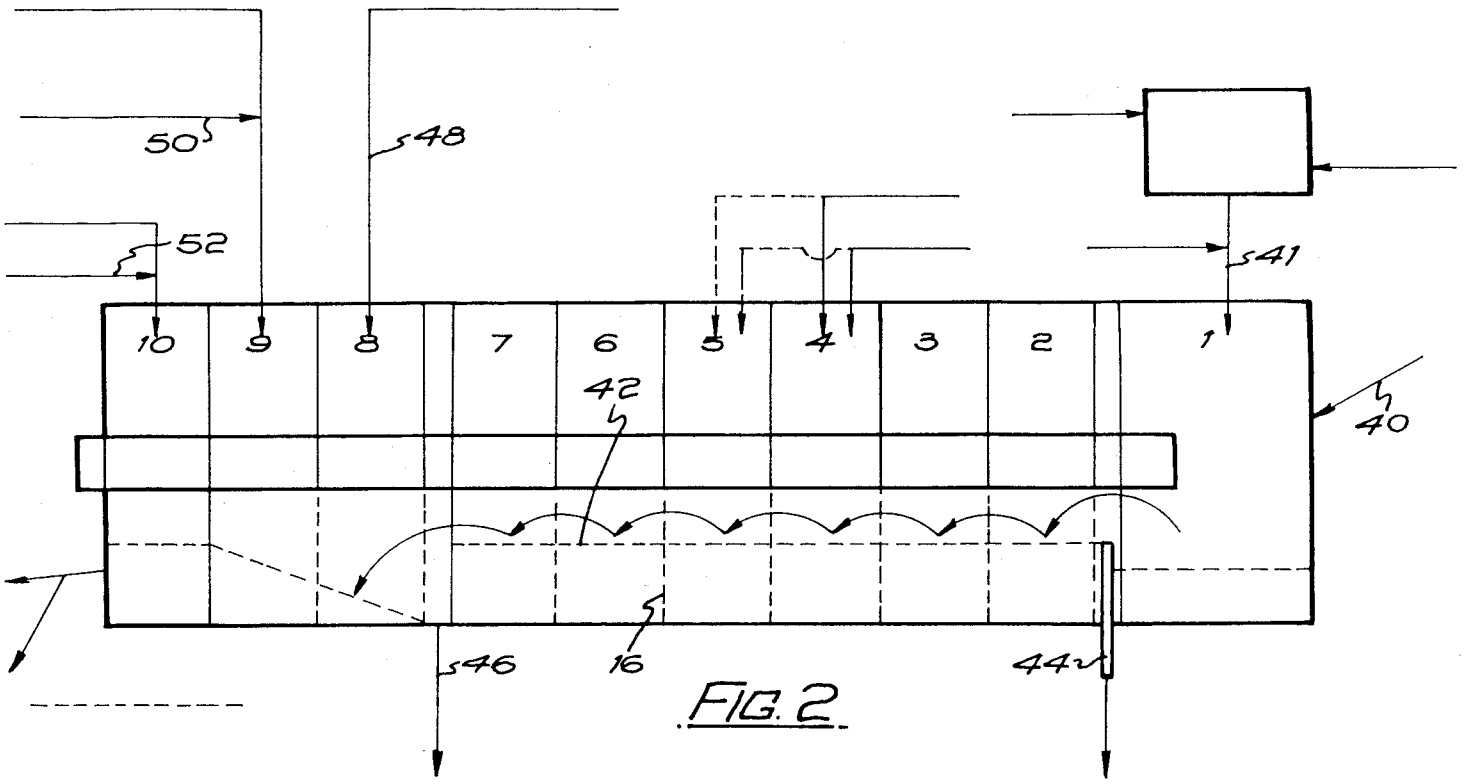
FIG. 2 is a diagrammatic side view of the machine screw and illustrates the treatment chambers of the machine.

FIG. 2 shows diagrammatically the machine of FIG. 1 in side elevation, and the flights of the screw are indicated for simplicity by means of straight lines. FIG. 2 however is included in order to indicate diagrammatically the method of treating the jeans as they pass through the machine.

Figure 3:
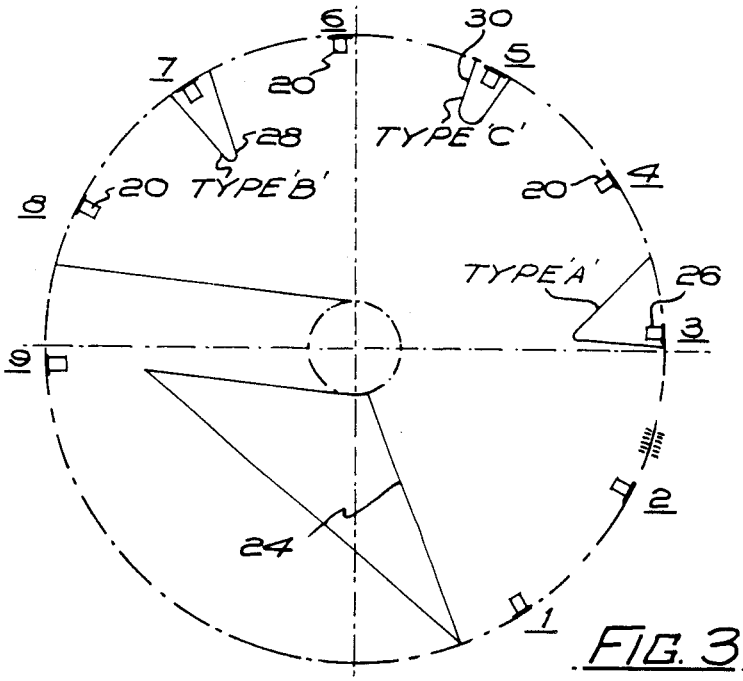
FIG. 3 is an end view of the screw.

If reference is made now to FIGS. 3 to 12, the machine modifications which are provided according to the embodiment of the invention are illustrated and will now be described. Referring firstly to FIG. 3, the leading edge of the screw at the input end is indicated by reference 24, and also shown in the figure are the lifter bars 20, these bars being located at regularly spaced intervals around the periphery of the drum to which the screw is connected, and seven lifter bar positions are shown. According to the embodiment, in the first compartment there are provided in addition to the lifter bars three lifter panels 26 (type A), 28 (type B) and 30 (type C). The design of these lifter panels 26 to 30, and their positions in relation to the leading edge 24 of the screw are of importance to the efficiency of operation of the embodiment of the invention.

The lifter panels serve to lift the jeans during the rocking movement of the screw, and to allow the jeans to fall and cascade therefrom back to the bottom of the drum, but without fouling with the centre tube 12. In other words the jeans when they drop from a lifter panel, must fall between the panel and the tube 12. If the jeans were lifted too high, and were charged onto the tube 12, then it might be possible for some pairs of jeans to progress into the second compartment prematurely.

Panel 26 which extends from the screw flight to the end of the drum, is of the form shown in FIGS. 5 and 6 and comprises a V-sectioned panel with faces 26A and 26B provided with outwardly turned ledges 26C and 26D at the outer ends of the V-section, such ledges serving as a means for welding or otherwise securing the panel to the inner surface of the machine drum. FIG. 6 shows that the panel 26 is made up in two sections 26E and 26F connected by a centre coupling section 26G. Rigidifying partitions 26H extend between the inner faces of the sides 26A and 26B. The panel 26 is made up in sections 26E and 26F with the centre section 26G, in order that the sections 26E, 26F whilst slidable relative to centre section 26G, between the flights, the ends cut to shape, the sections 26E and 26F moved outwardly and the ends finally welded to the flights and to the centre section 26G.

The panel 26 is in the specific example of the invention of the sizes (in mm) indicated, and indeed the screw is of the dimensions indicated in the drawing. Dimensioning and positioning of the various panels is important.

As regards panels 28 and 30, these are located at positions 7 and 5 as shown in FIG. 3 (which is to scale), and in compartment 1 only, and these panels are constructed similarly to the panel 26. Therefore a similar reference numbering system has been adopted in respect of the panels shown in FIGS. 7, 8, 9 and 10 in order to save further description. It is to be noted that the panel type C is of smaller height, 160 instead of 240 mm. The panels of FIGS. 7, 8, 9 and 10 are coupled to the machine in the manner described in relation to the panel type A.

The panels type A, B and C are in compartment 1 only, and as regards compartments 2 to 9, these compartments contain panels of the type D as shown in FIGS. 11 and 12, and these panels are located at positions 3 and 7 in each of the compartments. Panel type D is indicated by reference 34, and again panels of type B are constructed similarly to panel type A and a similar reference system has been adopted for FIGS. 11 and 12 so that further description is unnecessary.

Figure 4:
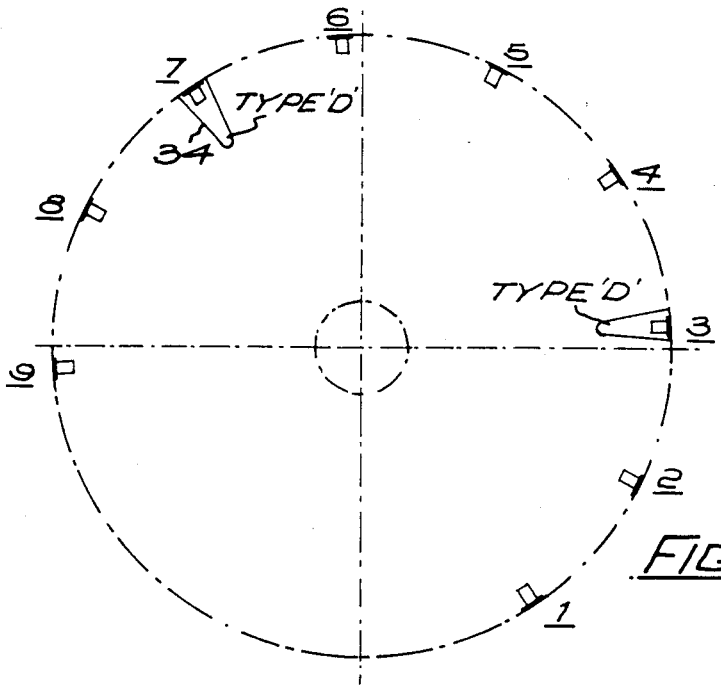
FIG. 4 is a sectional view of the screw.

FIG. 4 shows the positioning of panels type D in each of compartments 2 to 9.

In compartment 10, there is only one lifter panel, and this panel is positioned at position 7 in the last compartment.

The lifter panels according to the modification of the invention serve to lift the batches of jeans during the rocking movement of the screw hence the positioning of such panels is important as the panels are arranged to lift and drop the jeans in a tumbling action twice during each rocking movement.

It is to be noticed that the panels type D and type C are not provided with flanges such as flanges 26C, 26D, 28C and 28D as are provided in types A and B.

The sectional elevation of compartments 1, 2 and 3 shown in FIG. 13 indicates how the panels type D at position 7 are aligned with panel type B in compartment 1, and that panel type B is of a larger radial extent than the panels type D.

Figure 17:
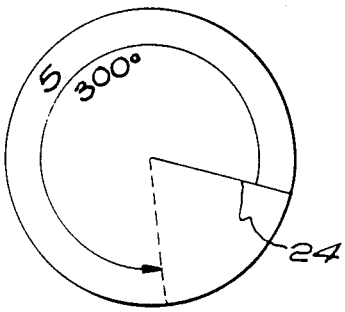

FIGS. 14 to 22 illustrate the sequence of operations of the screw when the machine is operated. In each of these figures, the screw is viewed from the input end, and the leading edge 24 of the screw is visible. In the position shown in FIG. 14, the screw is at rest, and when the machine is operated by depression of the appropriate button, the screw turns clockwise by 285° over a period of four and a half seconds to bring the leading edge 24 to the position shown in FIG. 15. In the next stage of movement, the screw is turned back anti clockwise through 285° during a period of four and a half seconds and during the two steps so far described, a batch of jeans, for example 30 pairs, is loaded into the first compartment along with clean water at 50°C. and an enzyme for softening the size on the jeans fabric. The jeans at this time do not require to be turned inside out. From the position shown in FIG. 15, the screw moves in a washing action, and the leading edge 24 is turned clockwise through an angle of 300° during a period of five seconds, and as the screw turns through 300°, so first of all lifter panel 26 engages and lifts the jeans until the panel 26 reaches a position somewhere between positions 8 and 9 in FIG. 3, when the jeans slide off the panel and cascade back to the bottom of the drum where they are caught by lifting panel 28 which again lifts the jeans to somewhere in the vicinity of position 9 when the jeans once more drop back to the bottom of the compartment. In the next washing cycle movement as shown in FIG. 17, the screw is turned anti clockwise through 300° over a period of five seconds and during this movement, the jeans are initially engaged and raised by the panel 28 from which they fall back into the base of the drum, and they are again engaged and lifted by the panel 26 until the panel 26 reaches the position shown in FIG. 3, the jeans having cascaded from panel 26 before it reaches the position shown. This cascading of the jeans during the rocking movement, and also cascading of the wash liquor effects washing of the jeans for the removal of size, and also keeps the jeans separated during the washing action. As many rocking motions as are required are executed, the screw moving between the FIGS. 16 and 17 position during this washing action.

Figure 15:
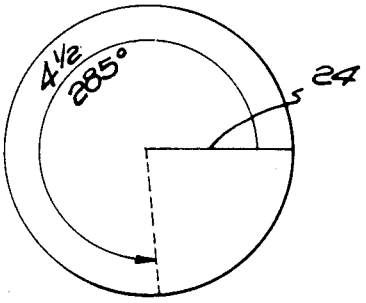
Figure 18:
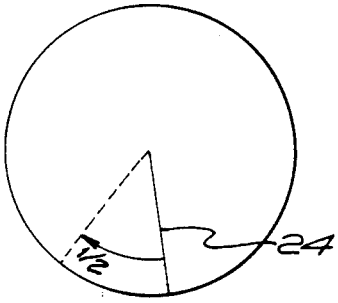
Figure 16:
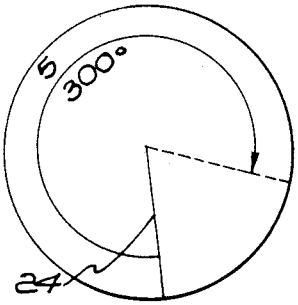
Figure 19:
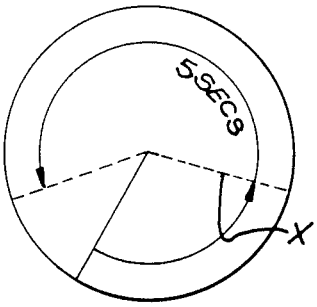
Figure 20:
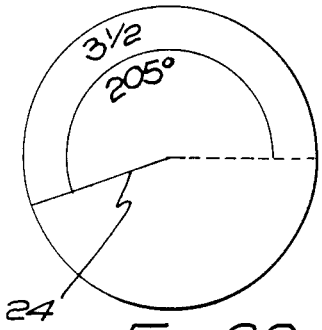
Figure 21:
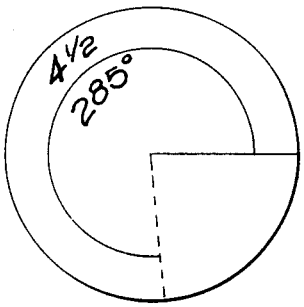
Figure 22:
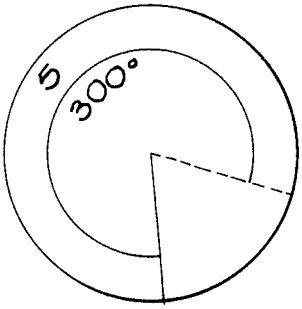

When it is desired to effect the transfer of the batch of jeans from the first compartment into the second compartment, the transfer sequence starts from the position shown in FIG. 17 when the leading edge 24 reaches the position shown in FIG. 18. In the first movement, the screw is turned clockwise for a period of half a second, and then is turned for a period of five seconds over an arc of 300° in an anti clockwise direction, which has the effect of moving the batch of jeans and the liquor into the second compartment. It is to be noted that at position X in the movement of travel of the leading edge of the screw, the loading of the next charge of jeans and liquor takes place. From the position shown in FIG. 19, the screw is then turned clockwise for a period of three and a half seconds over an arc of 205°, in order to ensure that the freshly charged jeans and liquor will be retained in compartment 1, and finally the screw is rotated anti clockwise for a period of four and a half seconds through an arc of 285°, until the position shown in FIG. 15 is once more reached, and in the next stage, the screw commences the washing cycle by the screw turning back and forth through an arc of 300° over periods of five seconds each. FIG. 22 shows the first washing movement of the screw.

In this fashion, batches of jeans to be washed are introduced into the machine, and the batches move forward progressively each time the screw executes the transfer sequence of operations indicated in FIGS. 18 to 21. If the machine is full in that there is a batch of jeans in every compartment, then at each of the said transfer sequence of operations, a batch of washed jeans is ejected from the discharge end of the machine.

Referring now to FIG. 2, the first compartment is shown as being larger than compartments 2 to 10, and this is because means must be provided for enabling the charging in of the garments as indicated by reference 40, and also the injection of hot clean water at 50°C. and the enzyme preparation as described herein as indicated by reference 41.

Compartments 2 to 7 are washing compartments, and the flights of the screw separating these compartments are provided with said through apertures 16 so that the level of liquor in the wash compartments as indicated by reference 42 will be substantially constant, although it is to be mentioned that each batch of jeans and its wash liquor tends to move from compartment to compartment and there is no significant flow of liquor between the respective compartments through the apertures 16.

The compartments 2 to 7 are drained through appropriate dip tubes 44 which rotate with the drum, but which also serve to maintain the liquor level. The dip tube may be set to give any desired depth of wash liquor, but in the present example the dip tubes are set so that the level will be 180 mm.

The chemical preparations are injected into compartment 4 or compartment 5 or both, such chemical preparations being as described herein. From the seventh compartment, which is the last wash compartment, each batch is moved into compartment 8. Compartment 8 has a drain 46 so that liquor is constantly draining therefrom, and compartment 8 is also supplied as indicated by reference 48 with cold flushing water at a rate of 1300 liters per hour. Compartment 9 is also a flushing compartment, and it is supplied with flushing water at 50° C. at the rate of 1500 liters per hour. Bleach is also introduced into compartment 9 as described herein and as indicated by reference 50.

Compartment 10 is a final rinse compartment, and it should be mentioned that the flight separating compartments 9 and 10 is not provided with apertures 16. Rinsing water at 50° C. is introduced into compartment 10 to give the jeans a final flushing, and at this stage chemical may also be introduced as indicated by reference 52, such chemical being introduced in such a quantity and being of the nature described herein.

The jeans which are discharged from the machine can be pressed directly by means of a membrane press, and are ready for stone washing by conventional methods or by a conventional method using the conditioning chemical as described herein.

In any event, the resulting jeans are effectively washed, are separated, and when subjected to stone washing and subsequent pressing, are of excellent and streak free appearance.

The provision of the lifter panels it was discovered meant the difference between the production of commercially acceptable and quality products as opposed to products which were quite unsatisfactory. The achievement of making the archimedean screw machine operate satisfactorily on jeans took considerable time and effort. A considerable amount of experimentation was necessary with the machine before the solution was reached. For example the machine was run at different speeds, different chemicals were used and so on but satisfactory products did not result until the lifting panels were provided.

I claim:

1. A washing machine comprising a rotatable washing drum arranged with its axis of rotation horizontal, said drum comprising:

(a) an archimedes screw;

(b) an input end and an output end to said screw;

(c) first to nth screw washing chambers lying in sequence from the input end to the output end and defined between the turns of the screw;

(d) a leading edge to said screw at the input end and lying radially with respect to said axis; and (e) lifter means for lifting and tumbling clothes to be washed in said chambers, said lifter means comprising:

(i) in the first chamber, at least two V-sectioned panels of different sizes extending between the screw turns and located on the periphery of the drum at the opposite side of the drum from said leading edge, the panels being arranged with apices of the V-sections facing the axis of rotation; and (ii) in the second to the nth−1 chambers, at least two V-sectioned panels extending between the screw scroll turns and located on the drum periphery at the opposite side of the drum from said leading edge, said panels being arranged with apices of the V-sections facing the axis of rotation.

2. A washing machine according to claim 1, wherein the nth chamber has only a single lifter means in the form of a V-sectioned panel extending between the screw turns and located on the drum periphery with the apex of the V-section facing the axis of rotation.

* * * * *